US008215803B2

(12) United States Patent
Singer

(10) Patent No.: US 8,215,803 B2
(45) Date of Patent: Jul. 10, 2012

(54) COVER SLEEVE FOR CFL BULB

(76) Inventor: Gregg Singer, South Orange, NJ (US)

( * ) Notice: Subject to any disclaimer, the term of this patent is extended or adjusted under 35 U.S.C. 154(b) by 290 days.

(21) Appl. No.: 12/543,598

(22) Filed: Aug. 19, 2009

(65) Prior Publication Data

US 2011/0044055 A1 Feb. 24, 2011

(51) Int. Cl.
*F21V 17/02* (2006.01)

(52) U.S. Cl. ..... 362/320; 362/255; 362/351

(58) Field of Classification Search ..... 362/360, 362/278, 311.01, 311.14–311.15, 320, 351, 362/355, 255–256
See application file for complete search history.

(56) References Cited

U.S. PATENT DOCUMENTS 2,326,004 A * 8/1943 Barrett ..... 359/359
3,418,651 A * 12/1968 Jacobson ..... 340/321
3,955,908 A 5/1976 Farrell
3,960,807 A 6/1976 McTaggart
5,032,077 A 7/1991 Farrell
5,635,262 A 6/1997 Best et al.
5,980,068 A 11/1999 Yu
7,125,417 B2 * 10/2006 Mizrahi ..... 607/114
D532,124 S 11/2006 Iwase
7,312,566 B2 * 12/2007 Foo ..... 313/489
7,434,961 B1 * 10/2008 Bernhardt et al. ..... 362/255
2003/0175499 A1 9/2003 Phillips
2006/0014919 A9 1/2006 Venderbosch et al.
2006/0146513 A1 * 7/2006 Liu ..... 362/34
2007/0014549 A1 * 1/2007 Demarest et al. ..... 392/393

* cited by examiner

*Primary Examiner* — Robert May
(74) *Attorney, Agent, or Firm* — Lackenbach Siegel, LLP

(57) ABSTRACT

A one-piece translucent but not transparent flexible plastic cover sleeve has a generally bulbous body and a downwardly extending neck that terminates at a bottom edge, and the neck has upwardly extending slits that terminate in respective orifices, so that the neck resiliently outwardly extends over a CFL bulb and then flexes inwardly to frictionally engage the CFL base. The cover sleeve substantially covers or hides the CFL bulb illumination, and provides a different illumination effect from the illuminated CFL bulb.

6 Claims, 3 Drawing Sheets

COVER SLEEVE FOR CFL BULB

BACKGROUND OF THE INVENTION

1. Field of the Invention

This invention relates generally to light bulbs and particular to compact fluorescent lamps (CFLs). The invention specifically relates to a cover for a CFL.

2. Background and Discussion of the Prior Art

A compact fluorescent lamp (CFL), also known as a compact fluorescent light bulb, is a type of fluorescent lamp designed to replace a conventional incandescent lamp. Many CFLs fit existing incandescent light fixtures and are starting to be more widely used as replacements for incandescent bulbs due to their much greater energy efficiency.

CFL bulbs have certain drawbacks. CFLs do not have an aesthetically pleasing look. CFLs are relatively expensive, and the less expensive CFL bulbs have particularly high color temperatures that provide an undesirable blue white illumination.

To enhance the appearance of CFL bulbs, the CFLs are enclosed in a reflector/cover lens in an attempt to replicate a standard reflector or parabolic (PAR) type bulb more typically used in ceiling recessed ("high-hats") lighting (R30 and R40 standard sizes). One such reflector-type fluorescent lamp is disclosed in U.S. D532,124 to Iwase et al.

U.S. Pat. No. 5,546,291 to Simes discloses a conversion kit assembly whereby a glass cover is fitted onto a CFL by inter-fitting collars and a clip member. U.S. Pat. No. 5,980,068 to Yu discloses a metal clip on cap that clips onto an annular slot of an attachment piece adjacent to the CFL base.

One recent attempt to improve the aesthetic is to provide a cover that has a clip attachment mechanism that attaches to a single spiral of the CFL tube, as disclosed in U.S. Pat. No. 7,434,961 to Bernhardt et al.

The prior art cover or cap constructions provide only a limited improvement in the aesthetic, and the CFL bulb is only partially covered with the undesirable blue white light being quite noticeable. The prior art construction were also generally costly to manufacture. And the prior art constructions are not generally useful as table lamps in contradistinction to ceiling fixtures.

The art desires a cover that provides a better aesthetic one that more fully eliminates the CFL blue white illumination and is particularly suitable as a table lamp, and which readily fits diverse CFL configurations, and yet is of practical design and manufacture so as to be commercially viable.

The present invention provides a cover that solves the aforesaid diverse art needs.

SUMMARY OF THE INVENTION

The invention is a translucent plastic cover having a bulbous body and neck extending downwardly from the body and having resilient flexure means for outwardly extending the neck to fit over and engage the base of a CFL. The cover encompasses essentially the entire CFL bulb. The cover is translucent to permit a desired illumination effect, but not transparent so as to hide the CFL bulb.

The invention, in one preferred embodiment, is a one-piece translucent but not transparent flexible plastic cover having a generally bulbous body and a neck extending downwardly from the body with the neck terminating at a bottom edge, and a pair of facingly disposed slits extending upwardly from the bottom edge and terminating in an orifice in the body. The user flexes and extends the neck outwardly so that the slits and orifices open to a body cross dimension that is greater than the cross dimension of the CFL bulb. The neck then flexes inwardly to frictionally engage the CFL base. The flexible snap-fit neck construction permits universal use with CFLs of diverse bulb and base sizes and configurations. The cover provides an illumination effect different from the illuminated CFL bulb. The cover is particularly suited where a CFL bulb is utilized in a table lamp.

DESCRIPTION OF THE INVENTION

Figure 3:
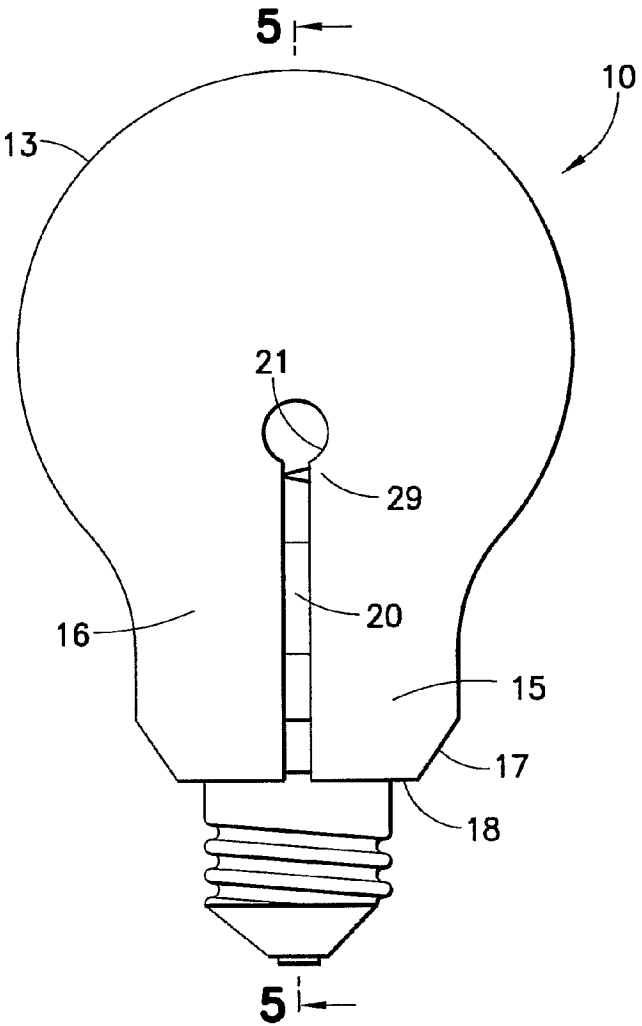
FIG. 3 is a front elevational view of the cover of FIG. 1 engaged on the CFL of FIG. 2.

Referring to the FIGS., there is shown the cover sleeve or cover 10 of the present invention. Cover 10 operably engages different CFLs, e.g. 11 and 12.

Cover 10 is a unitary one-piece flexible thermoplastic construction. Cover 10 has a bulbous body 13 which is contoured or concave at portion 14 of the body. Portion 14 then extends downwardly to form neck 15. Neck 15 has an upper portion 16 and a lower tapered portion 17 that terminates at bottom circular edge 18. A pair of slits 20 are facingly disposed at 180°. Each slit 20 extends from edge 18 upwardly and terminates at portion 29 in body 13. An opening or orifice 21 is formed at the upper end of each slit 20, for purposes hereinafter appearing.

Figure 1:
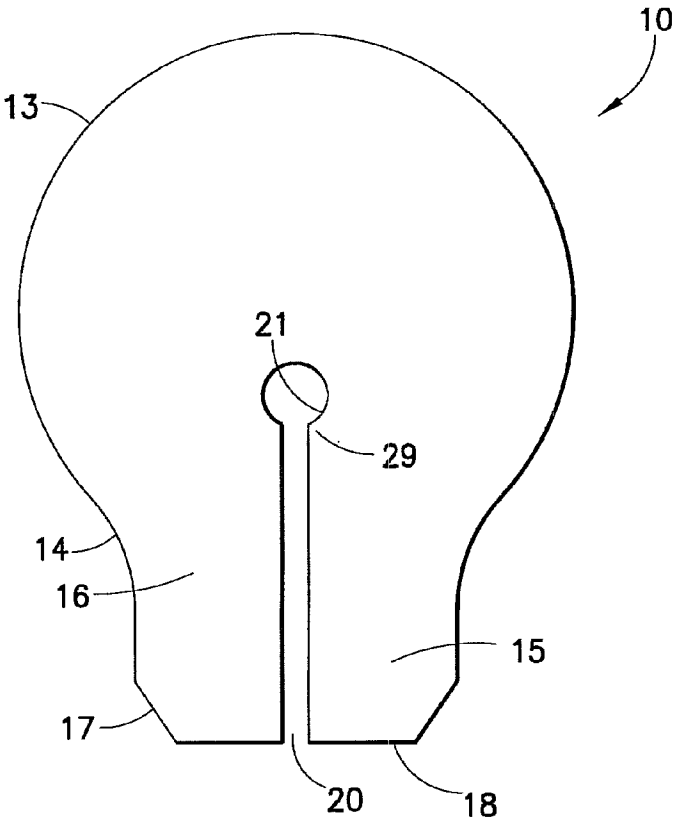
FIG. 1 is a front elevational view of the cover of the present invention.
Figure 2:
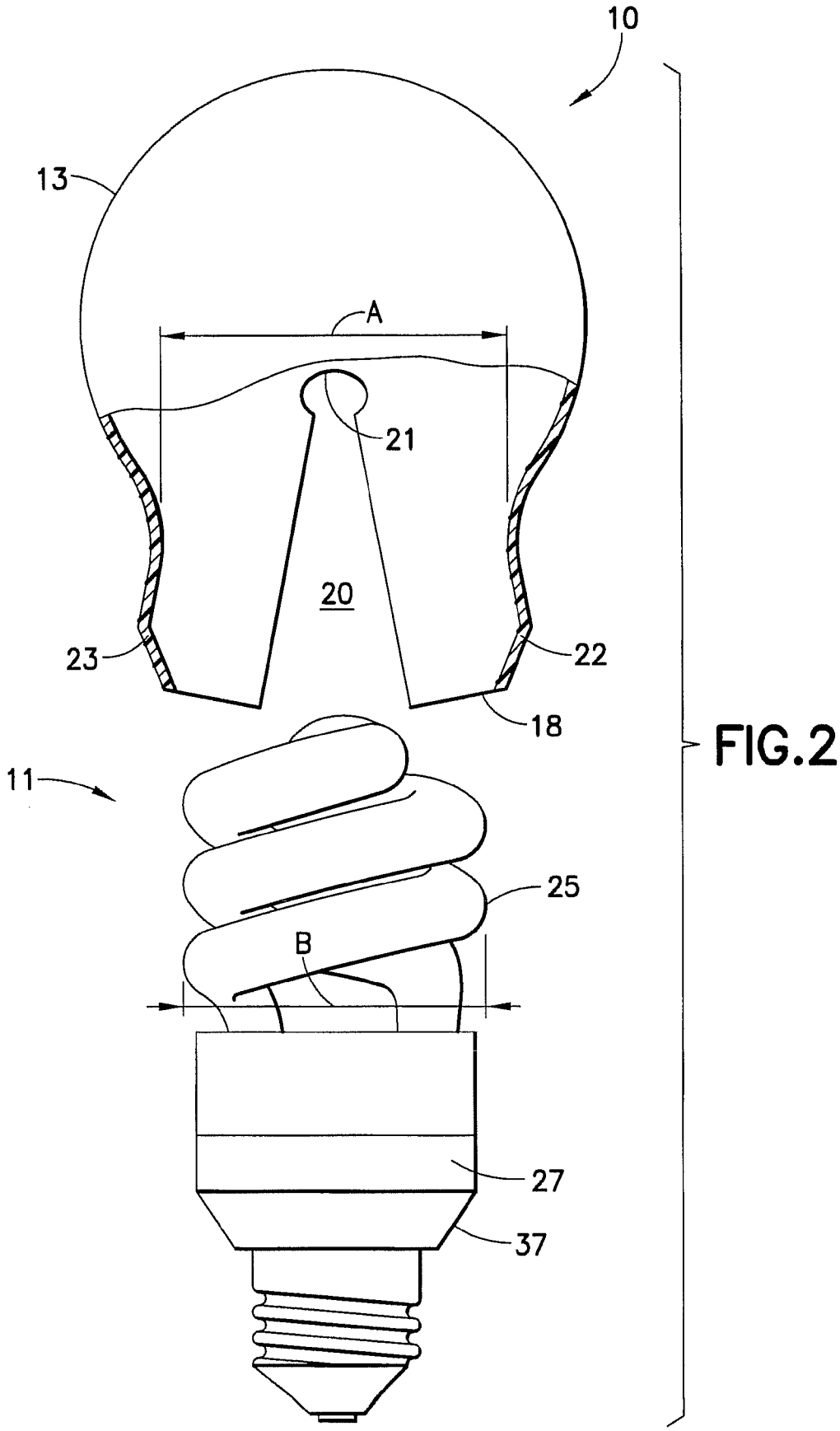
FIG. 2 is an assembly and partial fragmentary sectional view of the cover of FIG. 1 flexed outwardly to engage a CFL.
Figure 5:
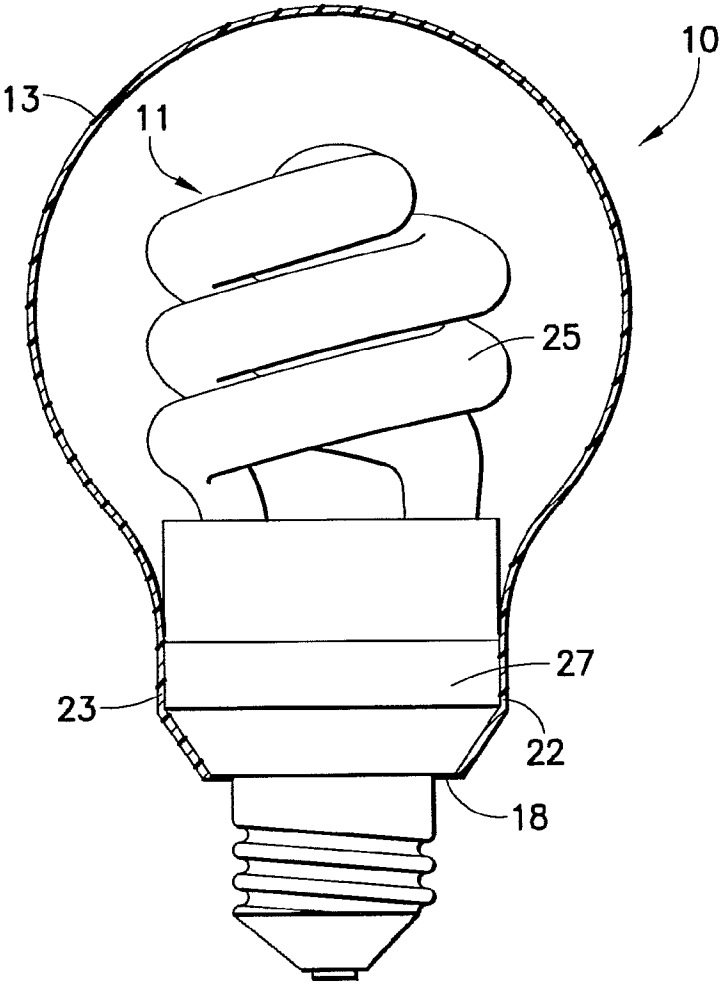
FIG. 5 is a sectional view of the cover taken along line 5-5 of FIG. 3.
Figure 4:
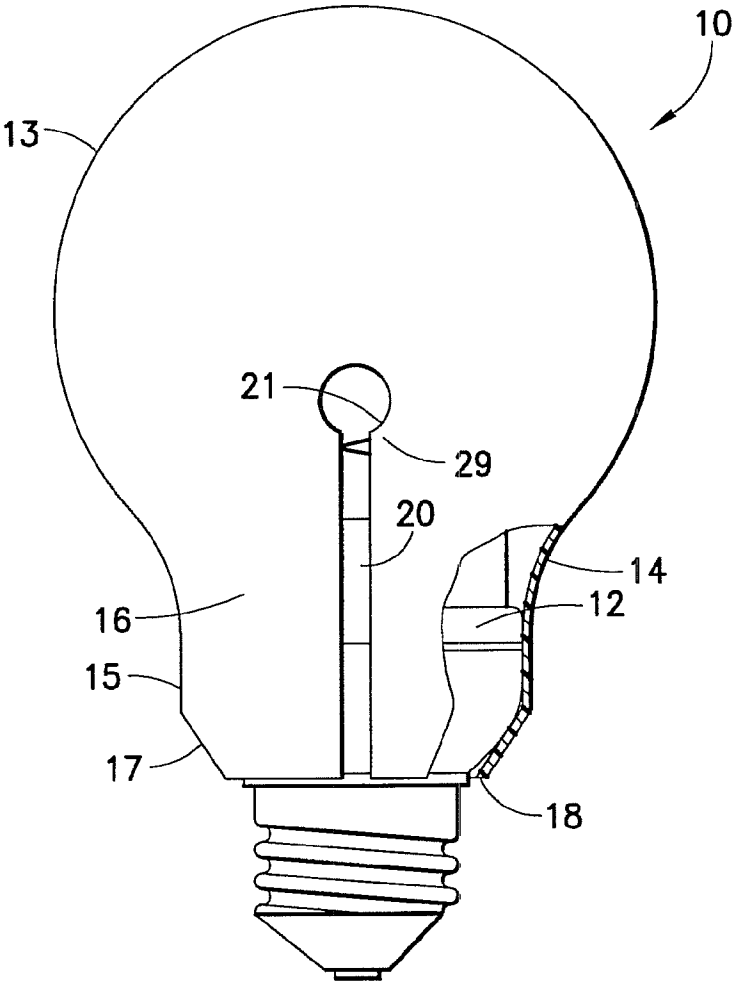
FIG. 4 is a fragmentary sectional view of the cover of FIG. 1 engaged on a CFL having a configuration different from the CFL shown in FIG. 1.

In the aforesaid manner of construction, the user engages portions 22 and 23 of neck 15 and flexes neck 15 outwardly by separating the slits and expanding or opening the orifices 20. See FIG. 2. The cover is flexed sufficiently so that inner surface contoured portion 14 has cross dimension A that is greater than the cross dimension e.g. B of tubular portion 25 of CFL 11. Orifice 21 has a greater cross dimension than slit 20 in the unflexed disposition (FIG. 1). The user then lowers the outwardly extending cover over the CFL and snap fits neck 15 onto the CFL base portions 27 and 37 (FIG. 2). It is important to note that the lower tapered portion of cover 10 accommodates a wide range of CFL base portions. The cover slit 20 is variously spaced when disposed on different CFLs depending upon the respective CFL base configuration. Slit 20 may be substantially narrower than depicted in the FIGS., where the flexure of the thermoplastic is particularly large.

Orifice 20 functions as a stress relief and to prevent cracks or tear propagation. Orifice 20 also functions to permit heated air disposed between the CFL bulb and the cover to exit by convectional forces. In this manner of construction, the thermoplastic cover is not unduly heated so as to be thermally distorted.

The thermoplastic cover sleeve is preferably manufactured by thermoforming, injection or extrusion blow molding or other thermoplastic molding means known in the art. Suitable injection blow molding machine for flexible thin molded bulbous constructions are disclosed in U.S. Pat. No. 5,032,077 to Farrell and U.S. Pat. No. 3,955,908 to Farrell, which references are incorporated herein in their entireties by reference thereto. Thermoplastics useful in the manufacture of the present cover sleeve include those having high thermal resistance, high temperature stability and crack stopping properties, such as disclosed in U.S. Pat. No. 3,960,807 to McTaggart; improved tear and impact resistance such as disclosed in U.S. Pat. No. 5,635,262 to Best et al.; effective translucent optical properties such as disclosed in US2006/0014919 to Venderbosch et al.; and many contain light diffusing particulates to impart translucent optical properties to moldable transparent thermoplastics, such as disclosed in US 2003/0175499 to Phillips; which references are incorporated herein in their entireties by reference thereto. Suitable moldable thermoplastics include polyethylene, particularly high density polyethylene (HDPE), polyesters, particularly polyethylene (PET) and copolymers thereof, polycarbonates, polystyrenes and styrene acrylonitrile copolymers (SAC), and the like. Suitable light diffusion particulates for incorporation into the thermoplastic resins to provide translucent characteristics include mica, silica, titanates, metal oxides, calcium carbonates, and the like, as is well known in the thermoplastic molding art. Coloring particulates or materials may also be incorporated in the thermoplastic resins as is well known in the thermoplastic molding art.

The cover may be translucent so as to the blue white illumination is modified to mimic the illumination of a conventional soft white incandescent bulb illumination.

Slit 20 and orifice 21 may be formed by die cutting the molded cover 10. The die cutting may be thermal die cutting or like means well known in the art to cut thermoformed plastic materials.

While the foregoing embodiment has been described with respect to two slits, it is within the contemplation of the present invention to provide other flexure means, such as only one elongated slit extending from the bottom edge substantially into the bulbous body.

The preferred embodiment of the invention has been illustrated and described, but changes and modifications can be made and some features can be used in different configurations without departing from the invention as defined in the claims.

What is claimed is:

1. A cover sleeve for a CFL bulb comprising:

a translucent plastic member comprising a general bulbous body and a neck comprising an edge, and means for outwardly extending the neck so that it fits over the CFL bulb and engages the base of the CFL bulb, whereby the cover sleeve provides an illumination effect different from the illuminated CFL bulb; said means for outwardly extending the neck comprises a first slit extending upwardly from the neck edge; further comprising a second slit facingly disposed to the first slit; each said slit extends from the lower edge to a termination portion in the bulbous body; and each said termination portion comprises an orifice, and wherein said orifice opens with the outward extension of the neck.

2. The cover sleeve of claim 1, said plastic comprises a thermoplastic comprising sufficient flexure and tear strength so that the neck extends outwardly to cover the CFL bulb, and flexes in return to frictionally engage the CFL base, without cracking or tear propagations.

3. The cover sleeve of claim 1, said plastic comprises a translucent but not transparent plastic having a level of translucence that transmits light from the illuminated CFL but hides the appearance of the CFL bulb.

4. The cover sleeve of claim 1, said cover consists of a one-piece molded construction.

5. A cover sleeve for a CFL bulb comprising;

a one-piece translucent but not transparent flexible plastic member comprising a general bulbous body and a neck formed with depending from the body, said neck comprises an edge, and means for outwardly extending the neck, wherein said means for outwardly extending the neck comprises at least one slit extending from the neck edge, wherein the neck flexes outwardly and the slit opens so that the body covers the CFL bulb and the neck then flexes inwardly to frictionally engage the CFL base, whereby the cover covers substantially the entire CFL bulb and provides an illumination effect different from the illuminated CFL bulb further comprising an orifice disposed at the end of the slit and spacedly disposed from the neck edge, said orifice having a cross dimension greater than the cross dimension before the outward extension of the neck.

6. The cover sleeve of claim 5, said translucent plastic member having a level of translucence that transmits light from the illuminated CFL bulb, but hides the appearance of the CFL bulb.

* * * * *